US010025226B2

(12) United States Patent
Hashimoto

(10) Patent No.: US 10,025,226 B2
(45) Date of Patent: Jul. 17, 2018

(54) SEALING MEMBER FOR A MOVABLE DEVELOPER CONTAINER OF A DEVELOPER CARTRIDGE

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,869

(22) Filed: Mar. 29, 2017

(65) Prior Publication Data

US 2017/0285532 A1 Oct. 5, 2017

(30) Foreign Application Priority Data

Mar. 31, 2016 (JP) ..... 2016-070704

(51) Int. Cl.
*G03G 15/08* (2006.01)

(52) U.S. Cl.
CPC ..... *G03G 15/0882* (2013.01); *G03G 15/0841* (2013.01); *G03G 2215/0687* (2013.01)

(58) Field of Classification Search
CPC ..... G03G 15/0841; G03G 15/0882; G03G 2215/1687
USPC ..... 399/106, 262
See application file for complete search history.

(56) References Cited

U.S. PATENT DOCUMENTS

| | | | | |
|---|---|---|---|---|
| 5,261,568 | A * | 11/1993 | Corby | G03G 15/0884 141/364 |
| 5,579,101 | A * | 11/1996 | Omata | G03G 15/0868 222/DIG. 1 |
| 5,729,797 | A * | 3/1998 | Okada | G03G 15/0872 222/DIG. 1 |
| 7,123,855 | B2 * | 10/2006 | Yuan | G03G 15/0884 399/106 |
| 9,063,464 | B2 | 6/2015 | Furutani et al. | |
| 2013/0336679 | A1 | 12/2013 | Furutani et al. | |
| 2014/0376955 | A1 * | 12/2014 | Takeuchi | G03G 15/0881 399/106 |

FOREIGN PATENT DOCUMENTS

| | | | | |
|---|---|---|---|---|
| JP | 58017465 | A * | 2/1983 | G03G 15/0872 |
| JP | 63239475 | A * | 10/1988 | |
| JP | 63294582 | A * | 12/1988 | G03G 15/0882 |
| JP | 08146740 | A * | 6/1996 | |
| JP | 2014-016592 | A | 1/2014 | |

* cited by examiner

*Primary Examiner* — Robert Beatty
(74) *Attorney, Agent, or Firm* — Banner & Witcoff, Ltd.

(57) ABSTRACT

A developer cartridge includes a developer container, a casing, a sealing member, and a drive input. The developer container is configured to sealingly contain developer therein. The developer container has an outlet through which the developer flows out of the developer container. The casing is configured to accommodate the developer container therein. The casing supports the developer container to allow the developer container to rotate about an axis thereof in a rotating direction. The sealing member is configured to seal the outlet. The drive input is configured to transmit rotational driving force to the developer container. The sealing member is fixed to the casing.

18 Claims, 8 Drawing Sheets

SEALING MEMBER FOR A MOVABLE DEVELOPER CONTAINER OF A DEVELOPER CARTRIDGE

CROSS-REFERENCE TO RELATED APPLICATION

This application claims priority from Japanese Patent Application No. 2016-070704 filed on Mar. 31, 2016, the content of which is incorporated herein by reference in its entirety.

FIELD OF DISCLOSURE

Aspects of the disclosure relate to a developer cartridge including a casing and a developer container disposed in the casing.

BACKGROUND

A known developer cartridge includes a casing and a baglike developer container disposed in the casing. The developer container contains developer. The developer container has an outlet through which the developer flows out of the developer container. The outlet is sealed by a film-like sealing member. The sealing member is fixed to a shaft of an agitator. Rotating the agitator causes the sealing member to be separated from the developer container. This allows the developer to be discharged from the developer container to the casing of the developer cartridge through the outlet.

SUMMARY

Some developer may remain in the developer container while most are discharged from the developer container. That means some toner may not be used for printing.

According to the one or more aspects of the disclosure, a developer cartridge may include a developer container, a casing, a sealing member, and a drive input. The developer container may be configured to sealingly contain developer therein. The developer container may have an outlet through which the developer flows out of the developer container. The casing may be configured to accommodate the developer container therein. The casing may support the developer container to allow the developer container to rotate about an axis thereof in a rotating direction. The sealing member may be configured to seal the outlet. The drive input may be configured to transmit rotational driving force to the developer container. The sealing member may be fixed to the casing.

DETAILED DESCRIPTION

Figure 1:
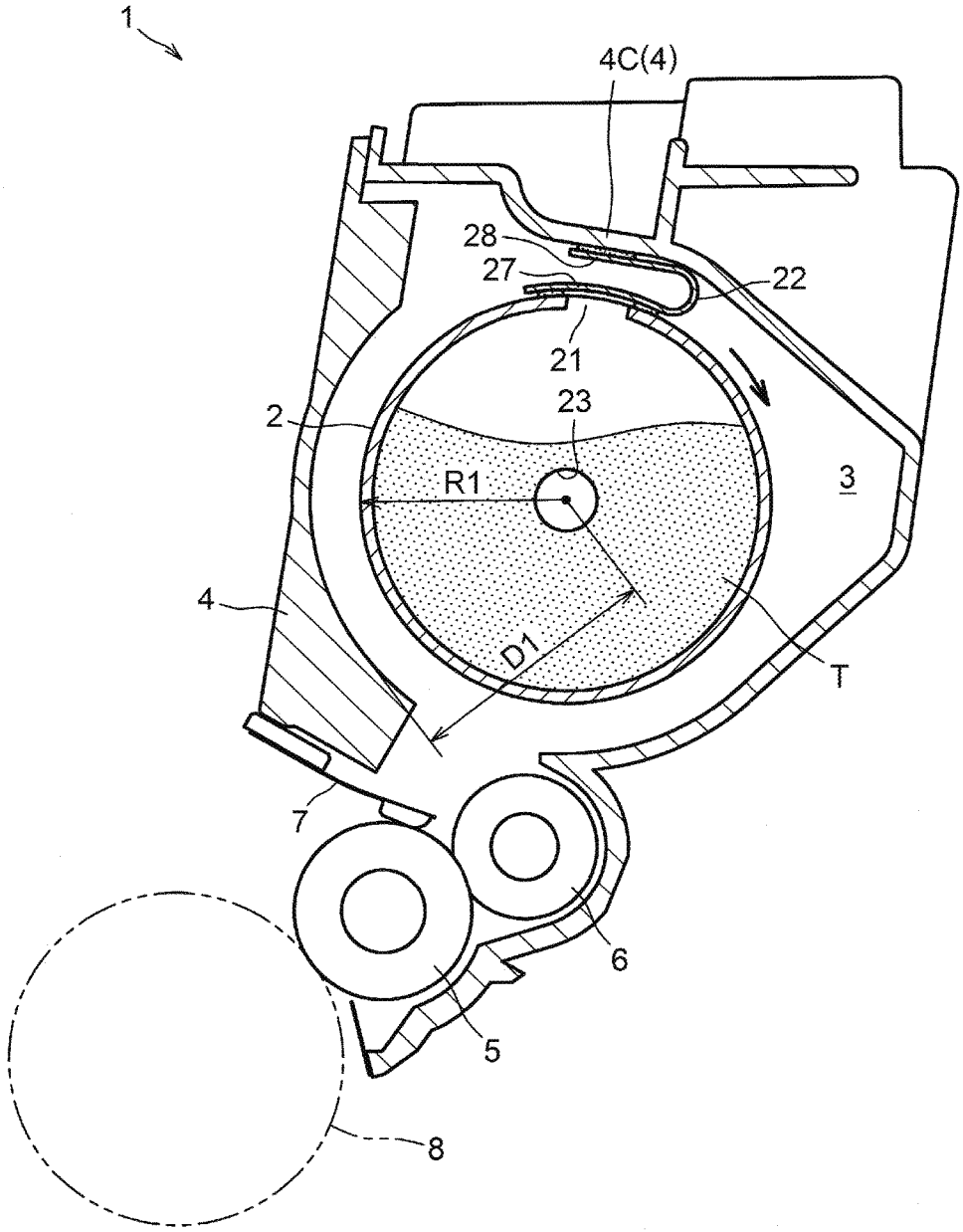
FIG. 1 is a cross-sectional view of a developer cartridge in an illustrative embodiment according to one or more aspects of the disclosure, wherein the developer cartridge is viewed along an axis of a developer container of the developer cartridge.

An illustrative embodiment and its modifications according to one or more aspects of the disclosure are described in detail with reference to the accompanying drawings, wherein similar reference numerals may correspond to similar components throughout the various drawings.

As depicted in FIG. 1, a developer cartridge 1 includes a developer container 2, a resin-made or plastic casing 4 including a developer chamber 3, a developing roller 5, a supply roller 6, and a blade 7. The developer container 2 sealingly contains developer, e.g., toner T, and is disposed in the developer chamber 3.

The developing roller 5 is rotatably supported by the casing 4 and is disposed adjacent to or in contact with a photosensitive drum 8.

The supply roller 6 is rotatably supported by the casing 4 and is disposed in contact with the developing roller 5. The supply roller 6 is configured to supply the developer to the developing roller 5.

The blade 7 is supported by the casing 4 at one end while contacting the developing roller 5 at the other end. The blade 7 is configured to regulate a thickness of a toner layer on the developing roller 5.

The developer container 2 is rotatably supported by the casing 4. The developer container 2 is configured to rotate about an axis in a particular rotating direction, e.g., clockwise in FIG. 1. The developer container 2 is a cylindrical container having a circular shape when viewed along the axis. The circular shape of the developer container 2 has a radius R1 equal to or greater than two-thirds of a shortest distance D1 from the axis of the developer container 2 to an inner surface of the casing 4. The developer container 2 is made of, but not limited to, metal, e.g., aluminum.

Figure 2:
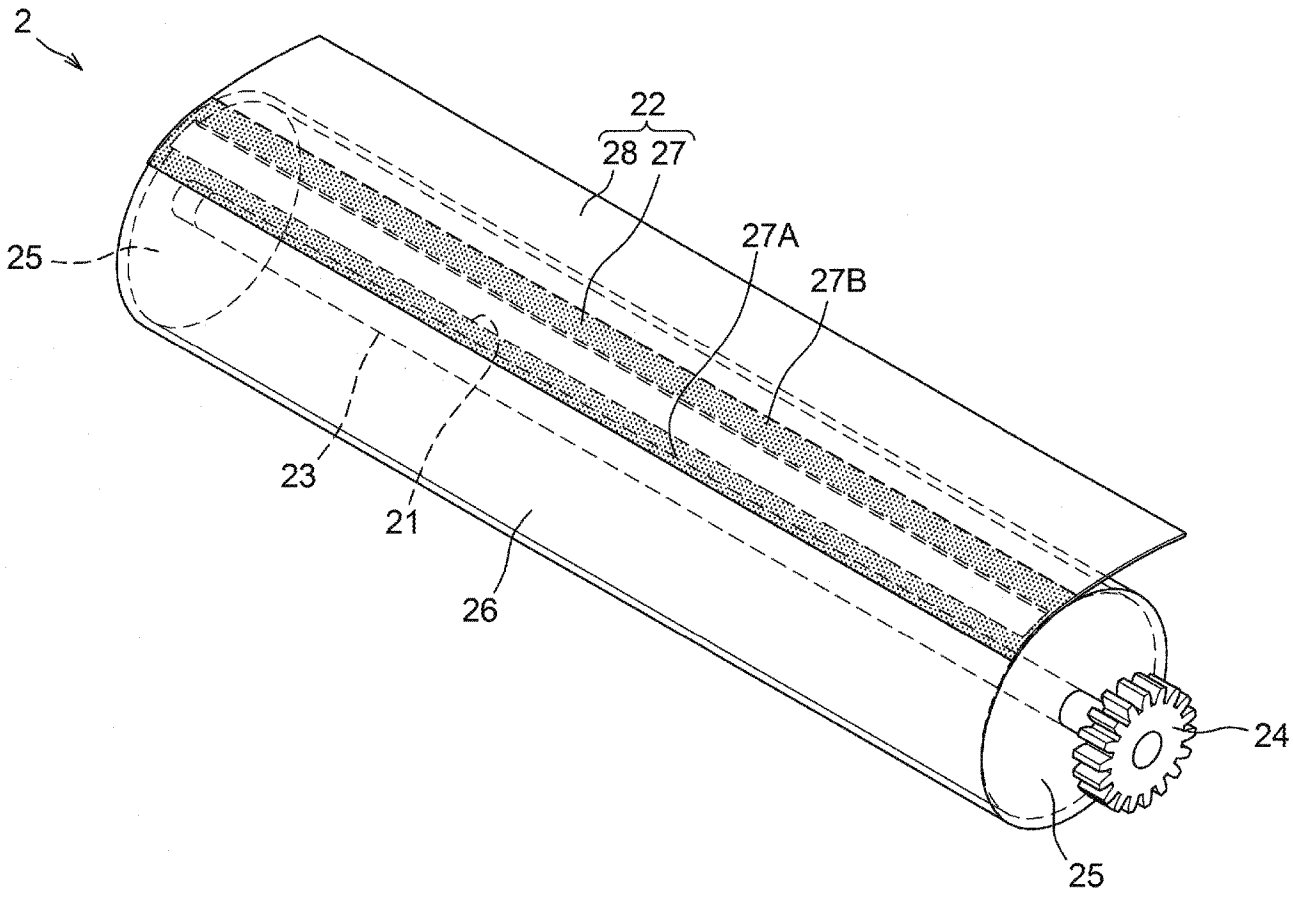
FIG. 2 is a perspective view of the developer container according to one or more aspects of the disclosure.

As depicted in FIG. 2, the developer container 2 includes first and second side walls 25 and a tubular portion 26. Each of the first and second side walls 25 has a circular shape. The tubular portion 26 is disposed between the first and second side walls 25. The tubular portion 26 has a rectangular outlet 21 extending from one of the first and second side walls 25 to the other one of the first and second side walls 25.

The outlet 21 is sealed by a sealing member 22.

Figure 3:
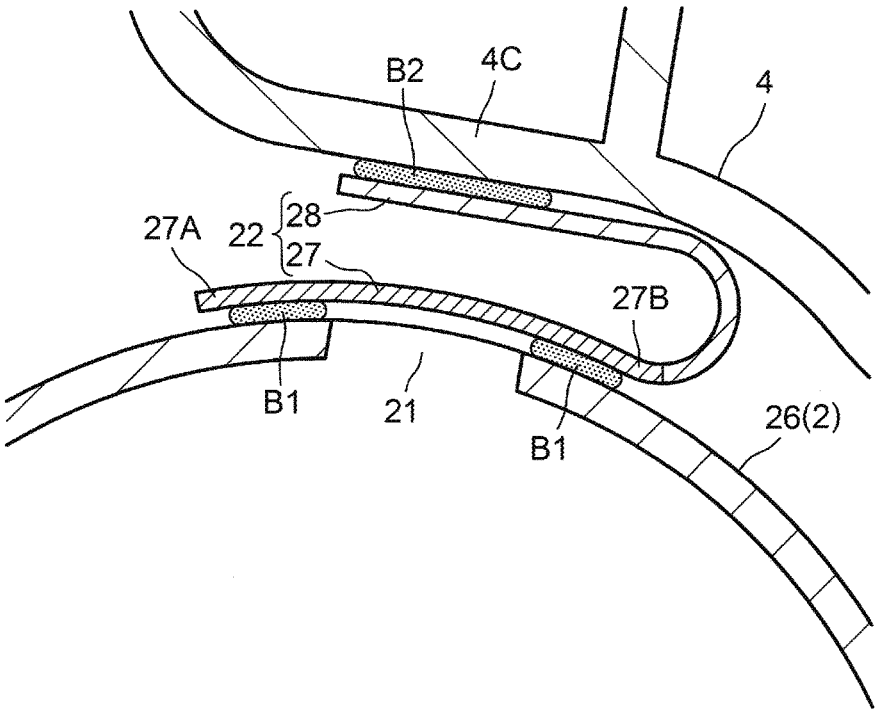
FIG. 3 is an enlarged cross-sectional view of a sealing member according to one or more aspects of the disclosure.

As depicted in FIG. 3, the sealing member 22 includes a sealing portion 27 and an attachment portion 28. The sealing portion 27 has a slightly larger area than the outlet 21 so as to seal the outlet 21. The sealing portion 27 includes an upstream end portion 27A and a downstream end portion 27B with respect to the rotating direction of the developer container 2. Hereinafter, "upstream" and "downstream" may be used in conjunction with the rotating direction of the developer container 2. The sealing member 22 is a sheet-like member having resilient restoring force. The sealing member 22 includes metallic material, e.g., aluminum, or resin material, e.g., polyethylene terephthalate ("PET"), polyethylene ("PE") or polypropylene ("PP"). In FIG. 3, the sealing portion 27 of the sealing member 22 is shown with hatching with a smaller pitch.

The sealing portion 27 is adhered to the developer container 2 by a first adhesive B1 applied to a periphery of the outlet 21, as shown in FIG. 2 with hatching. In short, the first adhesive B1 is applied around the outlet 21. The attachment portion 28 extends from the downstream end portion 27B and is attached to the casing 4 via a second adhesive B2. The first adhesive B1 has an adhesive strength weaker than an adhesive strength of the second adhesive B2.

The attachment portion 28 has one end continuous to the sealing portion 27 and an opposite end attached, via the second adhesive B2, to a fixing portion 4C of an upper wall of the casing 4. The attachment portion 28 extends downstream from the downstream end portion 27B of the sealing member 22, and then curves to extend upstream above an outer surface of the developer container 2 where the adhesives B1 are applied. Thus, the sealing member 22 is deformed into a "U" shape when adhered to the developing container 2. An outer surface of the sealing portion 27 of the sealing member 22, which is deformed into a "U" shape, faces the outer surface of the developer container 2.

Figure 4:
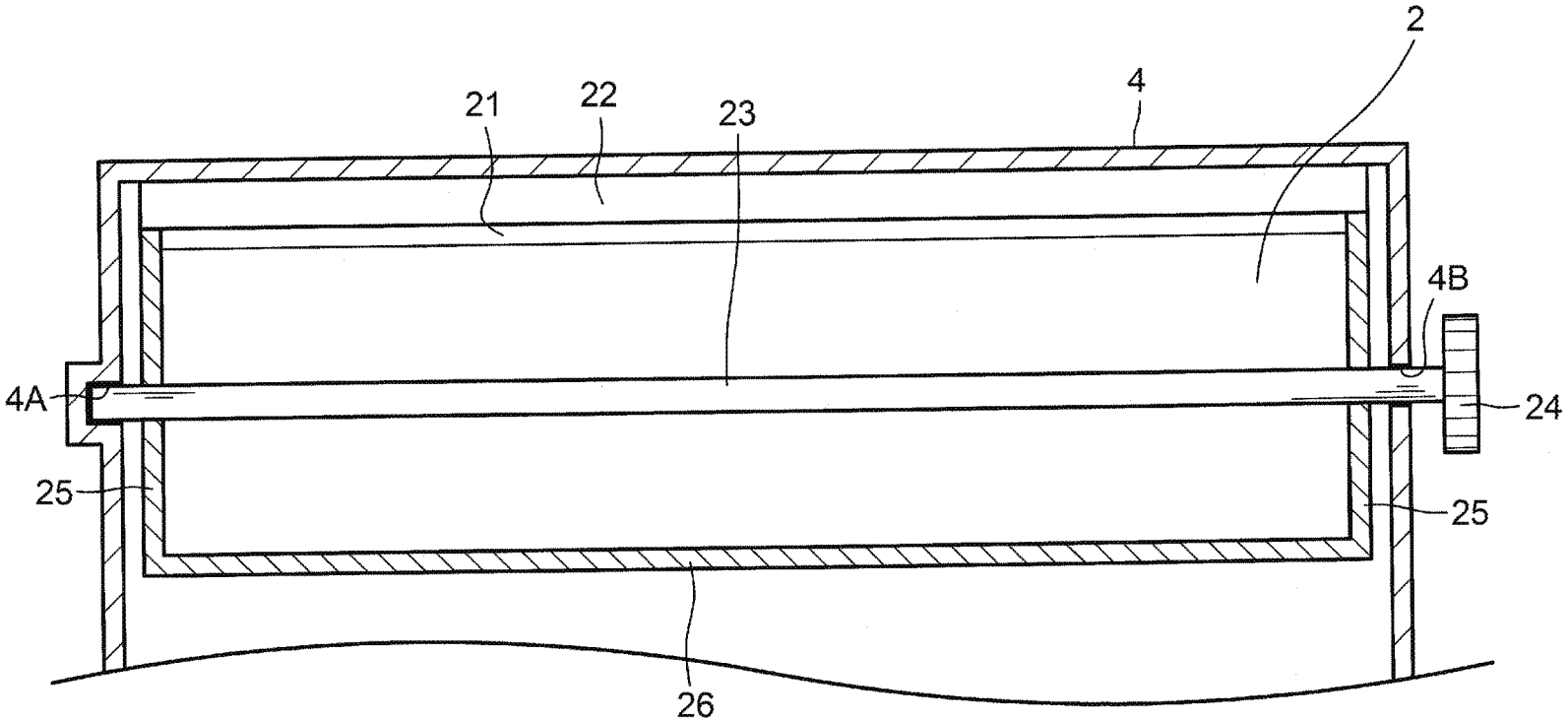
FIG. 4 is a cross-sectional view of the developer container and a casing of the developer cartridge according to one or more aspects of the disclosure.

As depicted in FIG. 4, a rotating shaft 23 extends through a central portion of each of the first and second side walls 25 of the developer container 2. The developer container 2 is fixed to the rotating shaft 23 at the first and second side walls 25. The rotating shaft 23 is rotatably supported by the casing 4. A first end portion of the rotating shaft 23 extending through the first side wall 25 is supported by a first bearing 4A recessed into an inner surface of the casing 4. A second end portion of the rotating shaft 23 extending through the second side wall 25 has a drive input, e.g., a gear 24, fixed thereto. The second end portion of the rotating shaft 23 is supported by a second bearing 4B provided at a portion of the casing 4 between the second side wall 25 and the gear 24.

Operations of the developer cartridge 1 in the image forming apparatus are now described.

The sealing member 22 seals the outlet 21 until the developer cartridge 1 is mounted to the image forming apparatus and receives driving force from a motor of the image forming apparatus.

The driving force from the motor to the gear 24 may cause the rotating shaft 23 and the developer container 2 to rotate integrally.

Figures 5A, 5B, 5C:
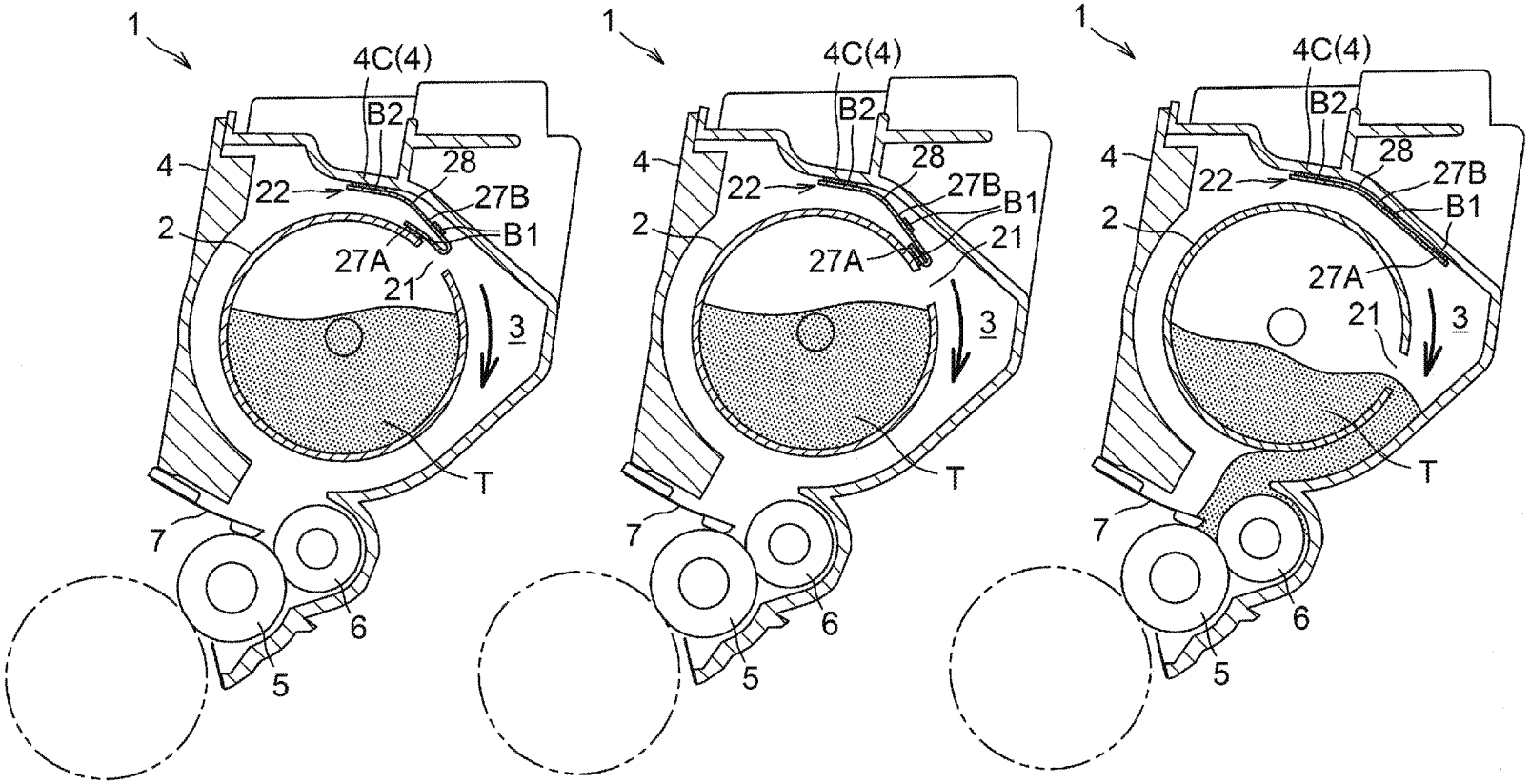
FIGS. 5A and 5B illustrate the sealing member being separated from the developer container according to one or more aspects of the disclosure.
FIG. 5C illustrates the sealing member separated from the developer container according to one or more aspects of the disclosure.

As depicted in FIG. 5A, slight rotation of the developer container 2 in the clockwise direction may cause the outlet 21 to move slightly away from the fixing portion 4C. The movement of the outlet 21 causes the attachment portion 28 fixed to the fixing portion 4C to pull the sealing portion 27. The second adhesive B2, which adheres the attachment portion 28 to the fixing portion 4C, has an adhesive strength greater than the first adhesive B1, which adheres the sealing portion 27 to the developer container 2. Accordingly, the downstream end portion 27B of the sealing portion 27 may be gradually separated from the developer container 2 as the developer container 2 rotates. Thereafter, the upstream end portion 27A of the sealing portion 27 may be gradually separated from the developer container 2 as the developer container 2 further rotates.

While the developer container 2 rotates, force perpendicular to the outer surface of the developer container 2 may be applied to the sealing portion 27 whereas force tangential to the outer surface may be applied to the attachment portion 28. Accordingly, the sealing portion 27 would be separated first if the first adhesive B1 should have the same adhesive strength as the second adhesive B2.

As depicted in FIG. 5B, further rotation of the developer container 2 may cause the outlet 21 to move further away from the fixing portion 4C. This may cause the downstream end portion 27B and the upstream end portion 27A of the sealing portion 27 to be sequentially separated from the developer container 2.

As depicted in FIG. 5C, further rotation of the developer container 2 may cause the entire sealing portion 27 to be separated completely from the developer container 2, resulting in the outlet 21 exposed. This may allow the toner T in the developer container 2 to be discharged through the outlet 21 into the developer chamber 3. The developer container 2 may continuously rotate with the outlet 21 exposed. The sealing member 22 may remain in the developer chamber 3 after the sealing portion 27 has been separated from the developer container 2. A portion of the sealing member 22 may be kept adhered to the fixing portion 4C and another portion of the sealing member 22 may be adhered to an inner surface of the upper wall of the casing 4 by the first adhesive B1 on the sealing portion 27. The resilient restoring force of the sealing member 22 may cause the entire sealing member 22 to extend along and adhered to the inner surface of the casing 4.

The toner T discharged into the developer chamber 3 may be supplied to the supply roller 6. Then, the toner T may be supplied from the rotating supply roller 6 to the developing roller 5, which is in contact with the supply roller 6. The blade 7 regulates the toner T on the developing roller 5 to form a thin toner layer on the developing roller 5. Then, the thin-layered toner T may be supplied to the photosensitive drum 8.

After the sealing member 22 (e.g., the sealing portion 27) has been completely separated from the developer container 2, the developer container 2 may continue rotating, with the outlet 21 exposed. This configuration may allow the toner T in the developer container 2 to be supplied to the casing 4 for image formation as the toner T in the casing 4 is supplied to the supply roller 6.

The illustrative embodiment may yield the following effects.

Rotation of the developer container 2 may cause the sealing member 22 to be separated from the developer container 2, resulting in the outlet 21 exposed. The toner T in the developer container 2 may flow into the developer chamber 3, through the outlet 21. Before the developer cartridge 1 is used, the outlet 21 of the developer container 2 containing the toner T may be kept sealed. When the developer cartridge 1 is used, the toner T may be discharged from the developer container 2.

This configuration avoids a user's operation of removing the sealing member 22 from the developer container 2, and accordingly avoids user's operational errors, otherwise the developer cartridge 1 would be soiled with the toner T. In addition, the outlet 21 of the developer container 2 containing the toner T may be kept sealed until the developer cartridge 1 is about to be used. This may avoid the toner T losing its quality such that the toner T may be usable for longer term.

As the developer container 2 may continue rotating after the outlet 21 is exposed, the toner T in the developer container 2 may be continuously and efficiently discharged to the casing 4. This configuration may eliminate or reduce the toner T remaining in the developer container 2.

The outlet 21 has a rectangular shape elongated along the rotating shaft 23. The outlet 21 extends from one side wall 25 to the other side wall 25 of the developing container 2. This configuration may eliminate or reduce the toner T remaining at corners of the developer container 2 which are defined by ends of the outlet 21 and the side walls 25.

The sealing portion 27 of the sealing member 22 may be gradually separated from the developer container 2, from a side closer to the downstream end portion 27B, which is provided at a downstream end portion of the sealing portion 27 in the rotating direction. Because the sealing portion 27 may not be entirely separated from the developer container 2 at one moment, force to separate the sealing portion 27 may be relatively reduced, which may lead to reduced torque necessary to drive the developer container 2.

Further, a portion of the sealing member 22 separated from the developer container 2 may adhere to the inner wall of the casing 4. Accordingly, the sealing member 22 may not be an obstruction when the toner T in the developer chamber 3 is agitated and supplied.

The developer container 2 has a circular shape when viewed along the axis of the developer container 2. Such shape may allow the developer container 2 to smoothly rotate, and to effectively use the space in the casing 4 when rotating. In addition, the developer container 2 has the radius R1 equal to or greater than two-thirds of the shortest distance D1 from the axis of the developer container 2 to the inner wall surface of the casing 4. This configuration may provide a greater space to the developer container 2 for containing the toner T.

The developer container 2 is made of alumina that includes moisture-proof characteristics. Such moisture-proof material may extend life of the toner T, and may allow the developer container 2 to be refilled with new toner.

While the disclosure is described in detail with reference to specific embodiments thereof, this is merely an example, and various changes, arrangements and modifications may be applied therein without departing from the spirit and scope of the disclosure. Modifications to the illustrative embodiment are described below.

First Modification

In the illustrative embodiment, the developer container 2 has a circular shape when viewed along the axis of the developer container 2. In one modification, a developer container may have, for example, a polygonal shape, when viewed along an axis thereof.

Figure 6:
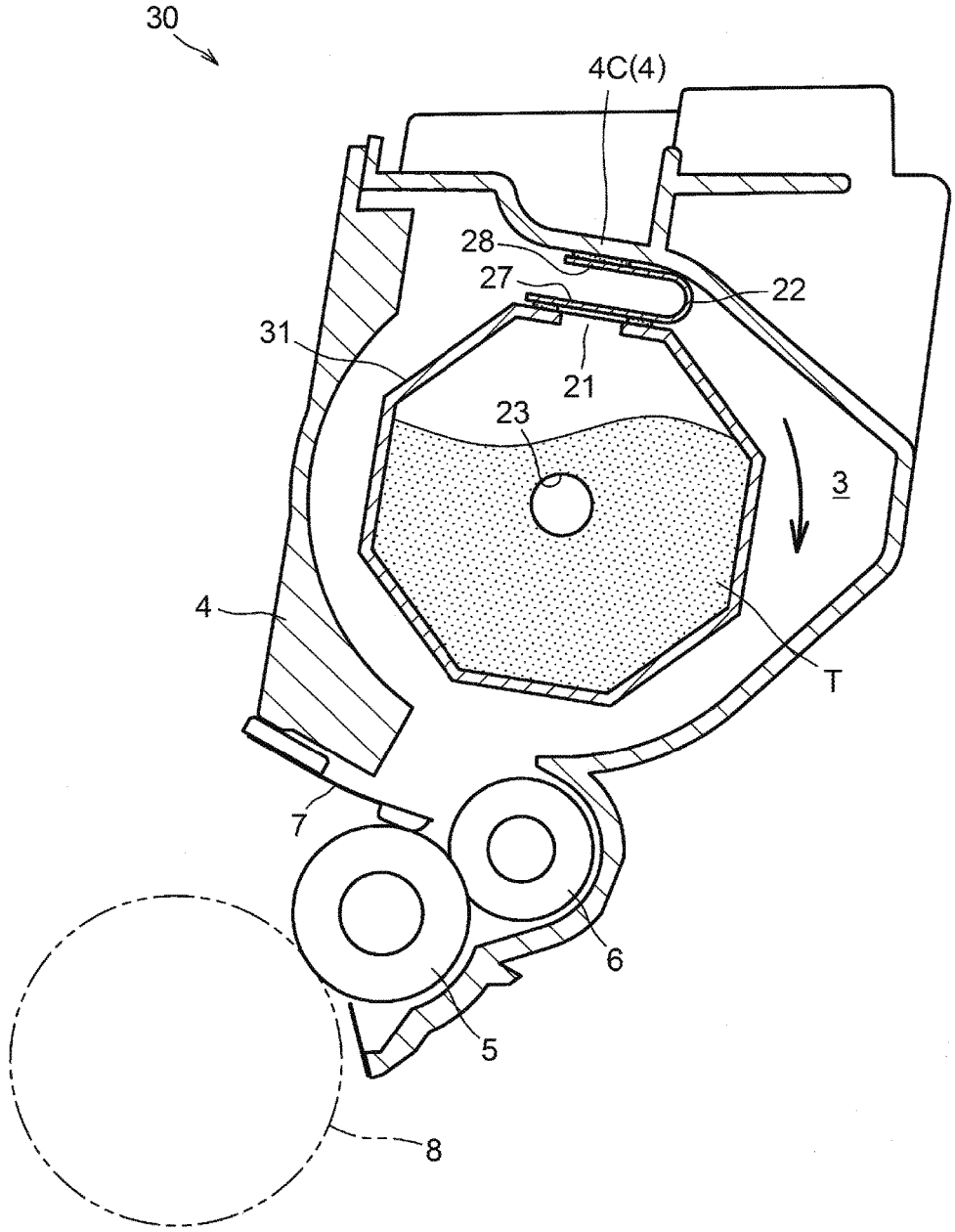
FIG. 6 is a cross-sectional view of a developer cartridge in a first modification according to one or more aspects of the disclosure.

For example, as depicted in FIG. 6, a developer cartridge 30 according to a first modification includes a polygonal-shaped (e.g., octagonal) developer container 31 when viewed along an axis of the container 31. The developer container 31 may allow the developer, e.g., the toner T, to be discharged from the developer container 31 efficiently, reducing the residual toner T in the container 31. The developer container 31 may not readily roll over, which may lead to easy-handling.

Second Modification

Figure 7:
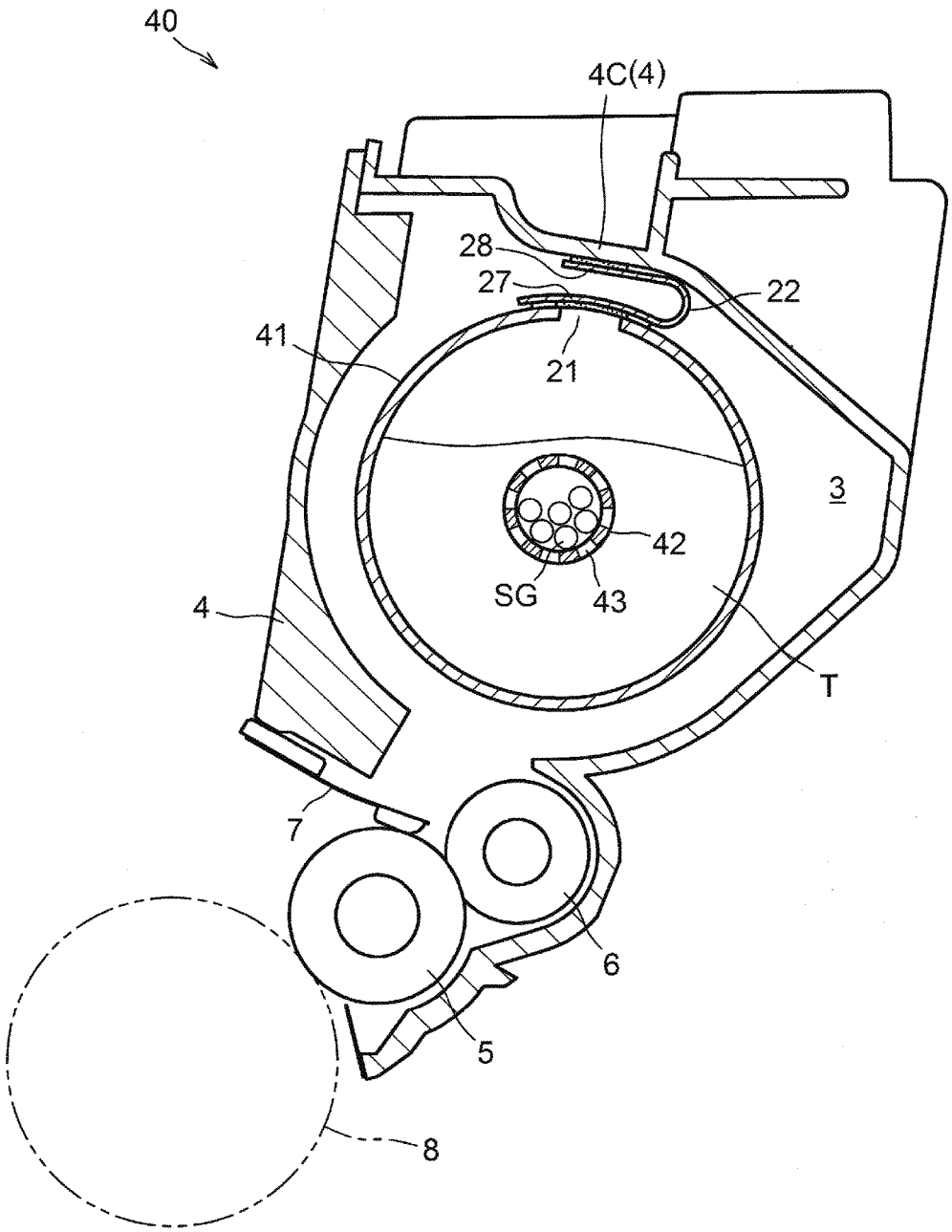
FIG. 7 is a cross-sectional view of a developer cartridge in a second modification according to one or more aspects of the disclosure.

The developer container according to the illustrative embodiment or the modification may contain silica gel. For example, as depicted in FIG. 7, a developer cartridge 40 according to a second modification includes a developer container 41 in which a desiccant container 42 with a plurality of vents 43 is disposed. The desiccant container 42 contains silica gel SG having moisture absorbency characteristics. The silica gel SG may further eliminate or reduce the toner T in the developer container 41 from losing its quality.

Third Modification

The developer container according to the illustrative embodiment or the first or second modification may include an agitating member disposed within a developer cartridge but outside a developer container.

Figure 8B:
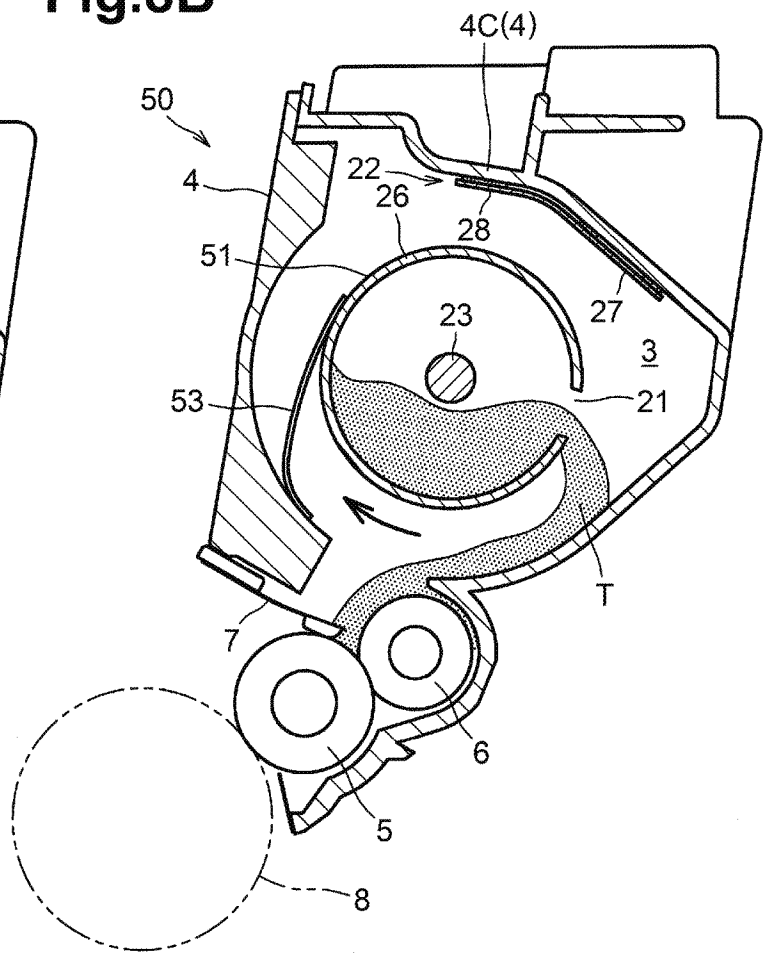
FIG. 8B is a cross-sectional view of the developer cartridge in the third modification according to one or more aspects of the disclosure, wherein the developer cartridge is unsealed.
Figure 8A:
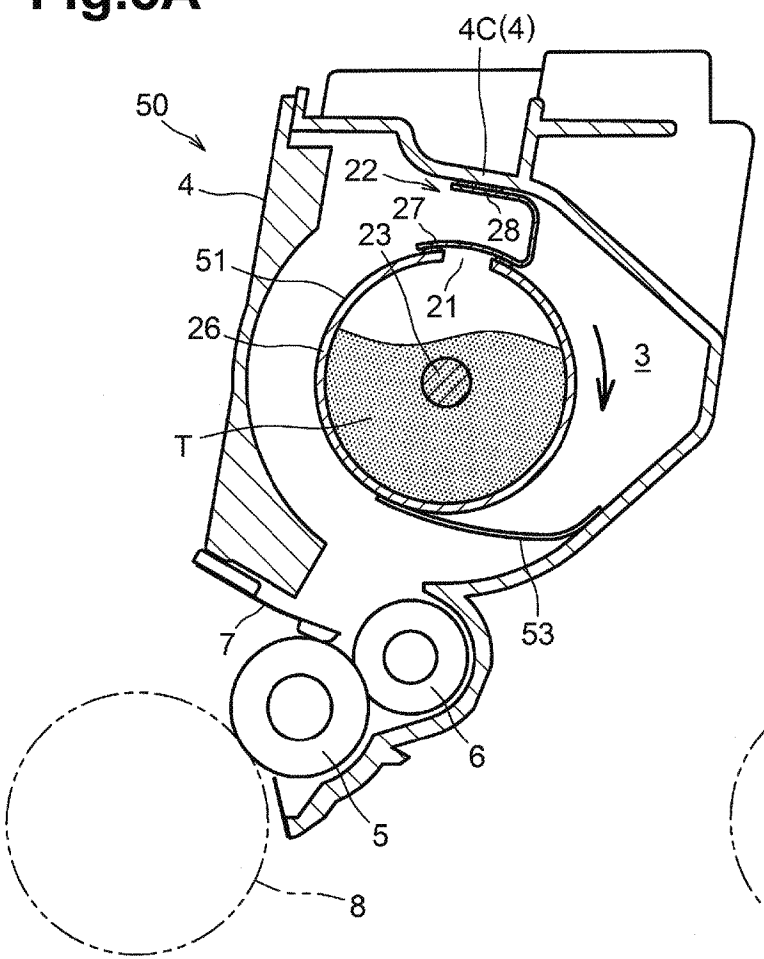
FIG. 8A is a cross-sectional view of a developer cartridge in a third modification according to one or more aspects of the disclosure, wherein the developer cartridge is sealed.

For example, as depicted in FIG. 8A, a developer cartridge 50 according to a third modification includes a developer container 51 including an agitating member 53. The agitating member 53 is a flexible or deformable film-like member. One end of the agitating member 53 is fixed to a particular portion of the outer surface of the tubular portion 26 of the developer container 51. The particular portion is located opposite to the outlet 21 across the rotating shaft 23 when viewed along an axis of the developer container 51. The opposite end of the agitating member 53 is pressed against the inner wall surface of the casing 4. Thus, the agitating member 53 is totally located in a deformed state between the inner wall surface of the casing 4 and the developer container 51.

As depicted in FIG. 8B, the developer container 51 may rotate to cause the toner T to flow out of the container 51 into the developer chamber 3 through the outlet 21. Rotation of the developer container 51 may cause the agitating member 53 to rotate. The agitating member 53 in a deformed state may move inside the casing 4 while making sliding contact with the inner wall of the casing 4. The agitating member 53, which is provided opposite to the outlet 21 when viewed along the axis of the developer container 51, may not close or cover the outlet 21. Accordingly, the agitating member 53 may agitate the toner T discharged into the developer chamber 3, without eliminating the smooth flow of the toner T in the developer chamber 3. In this modification, the sealing member 22 (e.g., the sealing portion 27) separated from the developer container 51 may be pressed against the inner wall of the casing 4 by the agitating member 53 and adhered to the inner wall of the casing 4. Accordingly, the sealing member 22 may not necessarily have resilient restoring force.

In the illustrative embodiment and the modifications, the developer container includes aluminum material. In another embodiment, a developer container may include, for example, other metallic material or resin materials. The resin materials may include, for example, polyethylene terephthalate ("PET"), polyethylene ("PE"), polypropylene ("PP"), polycarbonate ("PC"), acrylonitrile-butadiene-styrene ("ABS") resin, and acrylic resin. Those resin materials may reduce cost for manufacturing the developer container. Further, the resin materials may reduce a weight of the developer container, which, in turn, may reduce driving force to rotate the developer container.

In the illustrative embodiment and the modifications, the sealing member is adhered to the casing and the developer container with adhesive. In another embodiment, for example, the sealing member may be attached to the casing or the developer container by glue or thermos-compression bonding.

In the illustrative embodiment and the modifications, the developer container has a radius equal to or greater than two-thirds of the shortest distance from the axis of the developer container to the inner wall surface of the casing. In another embodiment, the radius may be shorter than two-thirds of the shortest distance from the axis of the developer container to the inner wall surface of the casing.

In the illustrative embodiment and the modifications, the sealing member is a sheet-like member having resilient restoring force. In another embodiment, the sealing member may be, for example, a sheet-like member having no resilient restoring force.

In the illustrative embodiment and the modifications, the developer cartridge includes the developer roller, the supply roller, and the blade. In another embodiment, the developer cartridge may not necessarily include those rollers and the blade.

What is claimed is:

1. A developer cartridge, comprising:

a developer container configured to sealingly contain developer therein, the developer container having an outlet through which the developer flows out of the developer container;

a casing configured to accommodate the developer container therein, the casing supporting the developer container to allow the developer container to rotate about an axis thereof in a rotating direction;

a sealing member configured to seal the outlet; and a drive input configured to transmit rotational driving force to the developer container;

wherein the sealing member is fixed to an interior surface of the casing, the interior surface of the casing facing the developer container.

2. The developer cartridge according to claim 1, wherein the sealing member includes:

a sealing portion configured to seal the outlet; and an attachment portion extending from a downstream end portion of the sealing portion with respect to the rotating direction of the developer container, the attachment portion being attached to a fixing portion of the casing.

3. The developer cartridge according to claim 2, wherein the sealing member is configured to elastically deform into a U-shape, and an outer surface of a portion of the U-shaped sealing member defining the sealing portion is attached to the developer container.

4. The developer cartridge according to claim 1, wherein the developer container has a circular shape when viewed along the axis of the developer container.

5. The developer cartridge according to claim 4, wherein the developer container has a radius equal to or greater than two-thirds of a shortest distance from the axis of the developer container to an inner wall surface of the casing.

6. The developer cartridge according to claim 1, wherein the developer container has a polygonal shape when viewed along the axis of the developer container.

7. The developer cartridge according to claim 1, wherein the developer container includes metal.

8. The developer cartridge according to claim 1, wherein the developer container includes resin.

9. The developer cartridge according to claim 1, wherein the developer container includes silica gel disposed therein.

10. The developer cartridge according to claim 1, wherein the sealing member has a sheet-like shape.

11. The developer cartridge according to claim 1, wherein the sealing member includes metal.

12. The developer cartridge according to claim 1, wherein the sealing member includes resin.

13. The developer cartridge according to claim 1, further comprising a rotating shaft, wherein the developer container includes a first wall at a first longitudinal end of the developer container and a second wall at a second longitudinal end of the developer container, the rotating shaft extending through both of the first and second walls.

14. The developer cartridge according to claim 1, wherein the sealing member includes an upstream end portion and a downstream end portion with respect to the rotating direction of the developer container, and wherein, as the developer container rotates in the rotating direction, the downstream end portion of the sealing member is separated from the developer container and the entire sealing member extends along the interior surface of the casing to which the upstream end portion of the sealing member is fixed.

15. A developer cartridge, comprising:

a developer container configured to sealingly contain developer therein, the developer container having an outlet through which the developer flows out of the developer container;

a casing configured to accommodate the developer container therein, the casing supporting the developer container to allow the developer container to rotate about an axis thereof in a rotating direction;

a sealing member configured to seal the outlet, wherein the sealing member is fixed to the casing;

a drive input configured to transmit rotational driving force to the developer container;

a sealing portion configured to seal the outlet; and an attachment portion extending from a downstream end portion of the sealing portion with respect to the rotating direction of the developer container, the attachment portion being attached to a fixing portion of the casing, wherein the sealing portion is adhered to the developer container by a first adhesive, and the attachment portion is adhered to the fixing portion by a second adhesive, and wherein the second adhesive has an adhesive strength greater than the first adhesive.

16. The developer cartridge according to claim 15, wherein the attachment portion is fixedly adhered to the fixing portion by the second adhesive.

17. The developer cartridge according to claim 16, wherein:

the sealing member has resilient restoring force, and the sealing member is configured to elastically deform into a U-shape when the sealing portion is adhered to the developer container by the first adhesive, and configured to entirely extend straight after the sealing portion has been completely separated from the developer container.

18. The developer cartridge according to claim 17, wherein the sealing portion is configured to extend along and be adhered to an inner surface of the casing after the sealing portion has been completely separated from the developer container.

* * * * *